US007144233B2

(12) United States Patent
Midorikawa

(10) Patent No.: US 7,144,233 B2
(45) Date of Patent: Dec. 5, 2006

(54) SCROLL FLUID MACHINE WITH A SILENCER

(76) Inventor: Youhei Midorikawa, c/o Anest Iwata Corporation, 3176, Shinyoshida-cho, Kohoku-ku,Yokohama-shi, Kanagawa (JP)

( * ) Notice: Subject to any disclaimer, the term of this patent is extended or adjusted under 35 U.S.C. 154(b) by 0 days.

(21) Appl. No.: 11/277,060

(22) Filed: Mar. 21, 2006

(65) Prior Publication Data

US 2006/0222547 A1 Oct. 5, 2006

(30) Foreign Application Priority Data

Mar. 30, 2005 (JP) ..... 2005-099349

(51) Int. Cl.
*F01C 1/02* (2006.01)
*F03C 2/00* (2006.01)
*F04C 18/02* (2006.01)

(52) U.S. Cl. ..... 418/55.1; 418/60; 418/101; 418/181

(58) Field of Classification Search ..... 418/55.1–55.6, 418/57, 181, 270, 60
See application file for complete search history.

(56) References Cited

U.S. PATENT DOCUMENTS 6,062,834 A * 5/2000 Masumoto et al. ..... 418/55.4
6,113,372 A * 9/2000 Lifson et al. ..... 418/55.1

FOREIGN PATENT DOCUMENTS

JP 04279782 A * 10/1992
KR 2004043679 A * 5/2004
KR 2004107724 A * 12/2004

* cited by examiner

*Primary Examiner*—Theresa Trieu

(57) ABSTRACT

A scroll fluid machine comprises a housing, a driving shaft, a fixed scroll fixed to the housing, and an orbiting scroll. A gas introduced from the outer circumference of the housing is compressed towards the center of the housing with revolution of the orbiting scroll by the driving shaft. The compressed gas is discharged through a discharge hole extending from the center outward in a radial direction. A silencer fits in the discharge hole to prevent noise caused by discharge of the gas.

4 Claims, 3 Drawing Sheets

PRIOR ART

SCROLL FLUID MACHINE WITH A SILENCER

BACKGROUND OF THE INVENTION

The present invention relates to a scroll fluid machine with a silencer to reduce as much as possible noise caused by a gas compressed and discharged during operation.

In a scroll fluid machine as shown in FIG. 3, an orbiting scroll is eccentrically revolved in a housing, so that a gas sucked on the outer circumference of the housing is guided into a compression chamber between the orbiting scroll and a fixed scroll, compressed towards a center and discharged from the center.

The housing 21 that has a compression chamber 22 comprises a casing 23 and a cover 24 and has a sucking inlet 25 on the outer circumference. The casing 23 and the cover 24 comprise fixed end plates 26,27 surrounding the compression chamber 22. On the inner surface towards the compression chamber 22, spiral fixed wraps 28,29 are provided respectively to form fixed scrolls 30,31.

Between fixed end plates 26 and 27, the orbiting scroll 32 is revolved around an axis of the compression chamber 22.

The orbiting scroll 32 has an orbiting end plate 33 which has orbiting wraps 34,35 engaged with the fixed wraps 28,29. The orbiting scroll 32 is pivotally mounted around an eccentric axial portion 39 of a driving shaft 38 via bearings 36,37.

The orbiting end plate 33 is engaged with the fixed end plates 26,27 with a three known pin-crank-type self-rotation preventing devices (not shown). The orbiting end plate 33 is revolved with rotation of the driving shaft 38 in the compression chamber 22 to allow radial distance of a space between the fixed wraps 28,29 and the orbiting wraps 34,35 to vary.

In the vicinity of the center of the casing 23, there is formed in the fixed end plate. 27 an axial opening 43 the inner end of which opens near the center of the compression chamber 22 and the outer end of which is closed by a stopper 42.

In the fixed end plate 27, the opening 43 communicates with a radial discharge hole 44 which fits in a discharge joint 45 with a check valve at the outer end.

The driving shaft 28 is driven by a motor (not shown), and cooling fans 46,47 are mounted to the driving shaft 38 close to the casing 23 and the cover 24.

With rotation of the driving shaft 38, the orbiting scroll 32 is eccentrically revolved by the eccentric axial portion 39 while being engaged with the fixed scrolls 30,31. So a gas is sucked from the sucking inlet 25, compressed in the compression chamber 22, transferred toward the center and ultimately discharged via the opening 43, the discharge hole 43 and the discharge joint 45.

Sound of gas discharged from the discharge hole 44 and discharge joint 45 is greatly high, and a silencer 50 is mounted to an outlet of the discharge hole 44 or discharge joint 45. However, the silencer 50 protrudes axially or radially of the scroll fluid machine to increase a size of the scroll fluid machine and/or to involve difficulty in handling.

SUMMARY OF THE INVENTION

In view of the disadvantages, it is an object of the present invention to provide a scroll fluid machine with a silencer such as an expansion-decompression tubular silencer without changing outline or size.

BRIEF DESCRIPTION OF THE DRAWINGS:

The features and advantages of the invention will become more apparent from the following description with respect to an embodiment as shown in appended drawings wherein.

DETAILED DESCRIPTION OF PREFERRED EMBODIMENTS

Figure 1:
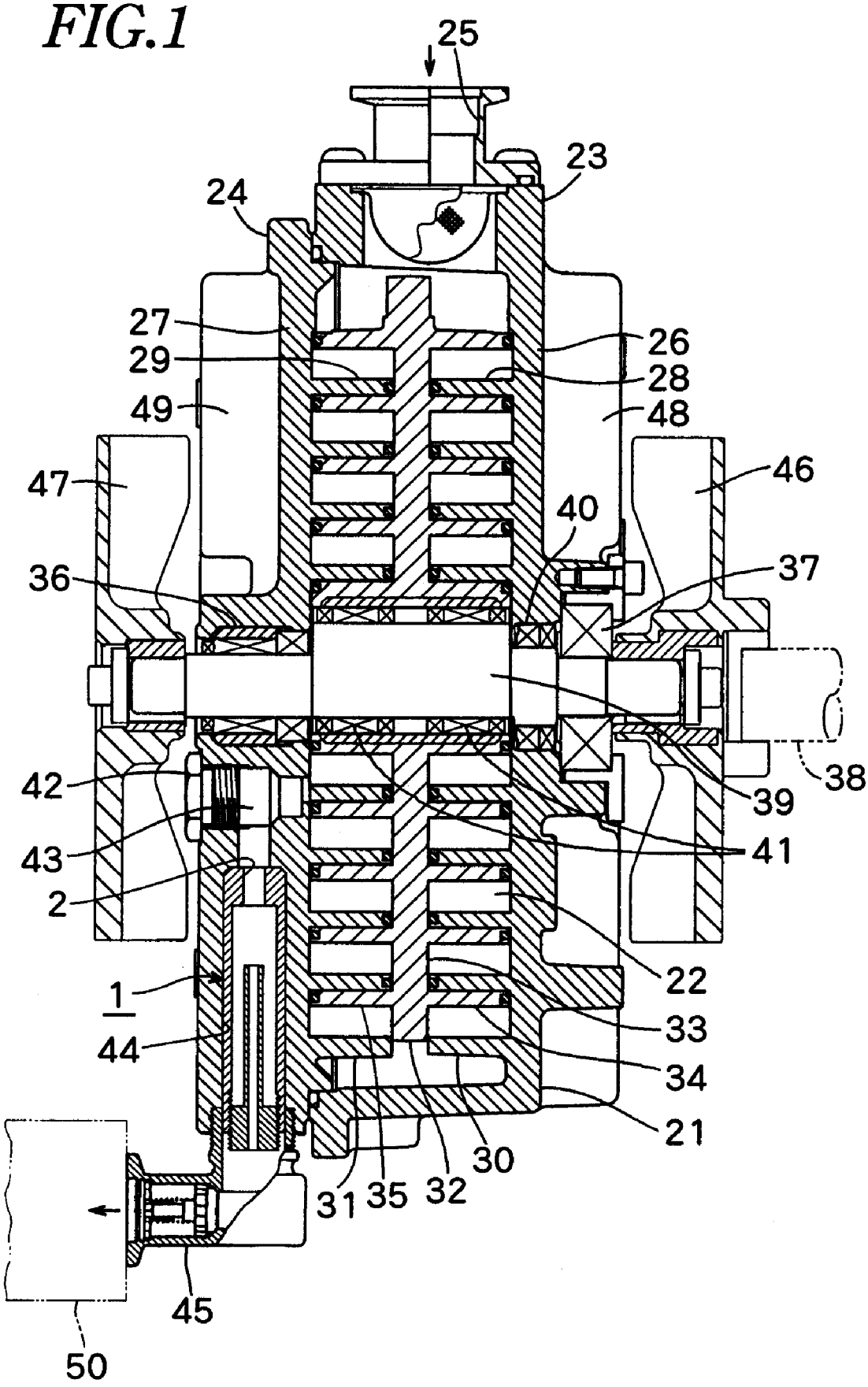
FIG. 1 is a vertical sectional side view of a scroll fluid machine according to the present invention.
Figure 3:
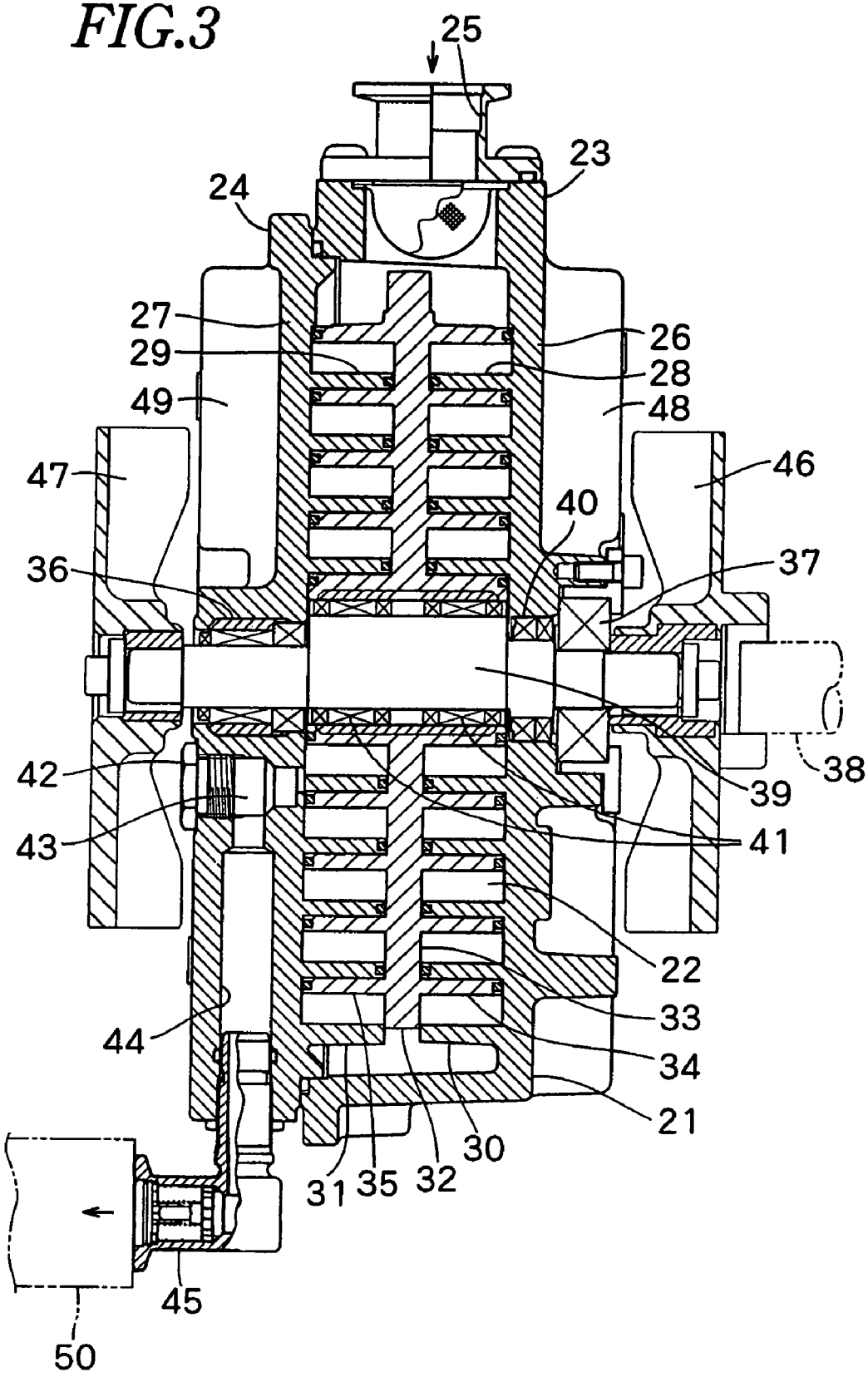
FIG. 3 is a vertical sectional side view of a known scroll fluid machine.

FIG. 1 shows a scroll fluid machine according to the present invention, which is the same as the scroll fluid machine in FIG. 3 except including a tubular silencer. The same numerals are allotted to the same parts or elements and their explanation will be omitted. Only different parts will be described.

An expansion/decompression-type tubular silencer 1 fits in a radial discharge hole 44 communicating with a through hole 43 in one of fixed end plates 27 of a scroll fluid machine in FIG. 1. An inlet hole 2 of the silencer 1 opens towards the center. The silencer 50 connected to the outlet of the discharge joint 35 in FIG. 3 can be omitted.

Figure 2:
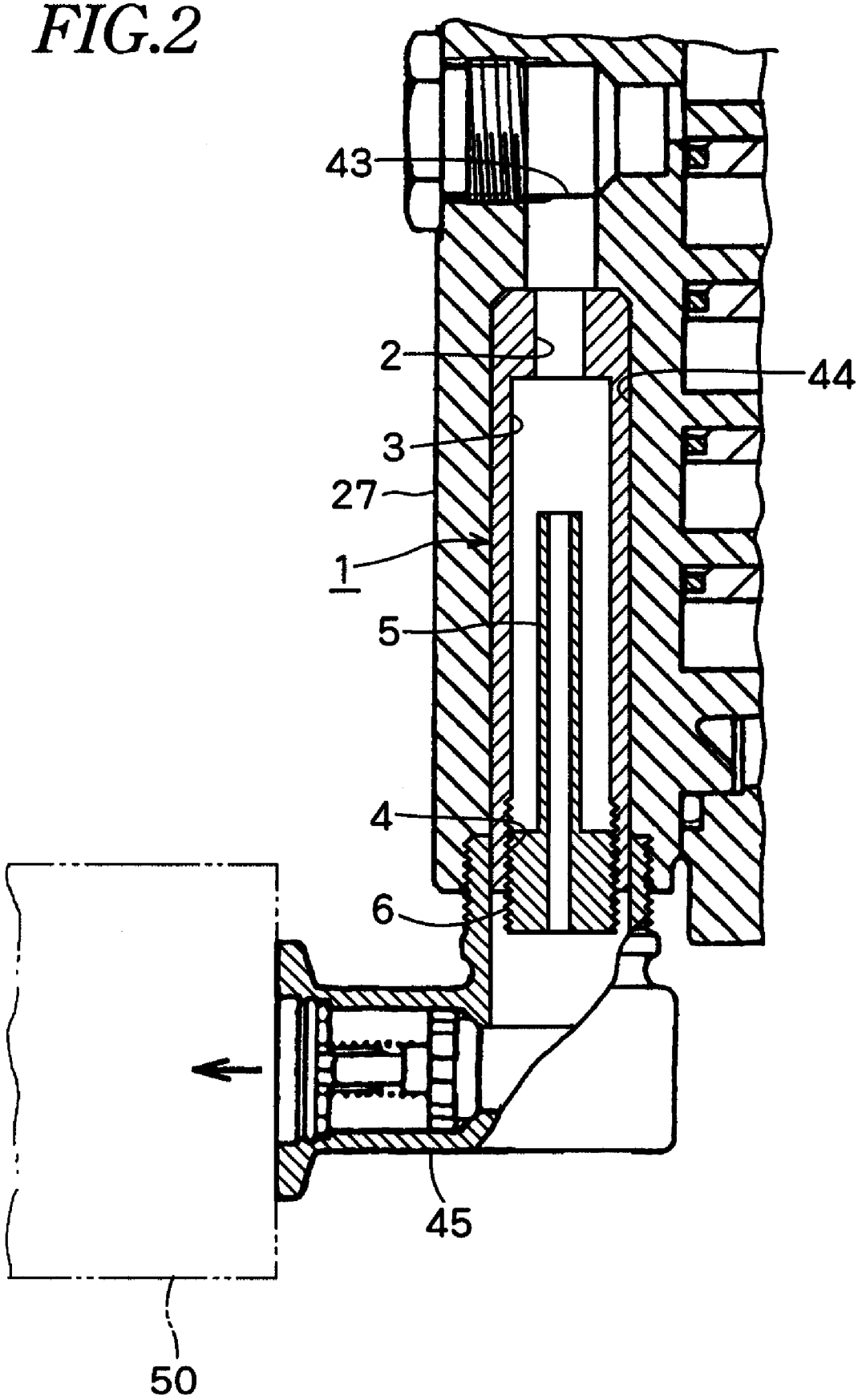
FIG. 2 is an enlarged vertical sectional view of a tubular silencer in FIG. 1.

In FIG. 2, in the silencer 1, the smaller-diameter inlet hole 2 communicates with a larger-diameter expansion hole 3 which has a female thread 4 at an exit. The female thread 4 engages with an adjusting nut 6 having a smaller-diameter introduction tube 5.

With operation of the scroll fluid machine, a gas is compressed and introduced into the through-hole 43 close to the center of the housing. The gas flows into the expansion hole 3 via the inlet hole 2 of the tubular silencer 1 and is expanded or decompressed. Thereafter, the gas is fed to part to be used via the introduction tube 5 and discharge joint 45.

In FIG. 1, the whole tubular silencer 1 fits in the radial discharge hole 44 without gaps, but part or most of the silencer may fits in a groove.

With operation of the scroll fluid machine, the compressed gas that flows into the discharge hole 44 via the through-hole 43 flows into the larger-diameter expansion hole 3 via the smaller-diameter inlet hole 2 of the tubular silencer 1 and is expanded or decompressed to prevent noise.

If variation in operation condition of the scroll fluid machine or in temperature causes variation in noise level, the adjusting nut 6 is turned to allow the instruction tube 5 to move axially to adjust effective length of the silencer 1.

The foregoing merely relates to an embodiment of the invention. Various modifications and change may be made by a person skilled in the art without departing from the scope of claims wherein:

What is claimed is:

1. A scroll fluid machine comprising:

a housing;

a driving shaft having an eccentric axial portion at one end and extending axially of the housing from a center;

an orbiting scroll comprising an orbiting end plate having an orbiting wrap and being rotatably mounted to the eccentric axial portion;

a fixed scroll fixed to the housing and comprising a fixed end plate having a fixed wrap and a discharge hole extending radially, a gas sucked from an outer circumference of the housing being compressed toward a center of the housing in a sealed chamber formed between the orbiting wrap and the fixed wrap to discharge the compressed gas via the discharge hole; and a silencer fitting in the discharge hole of the fixed end plate and having a smaller-diameter inlet hole and a larger-diameter expansion hole to expand or decompress the compressed gas outwards radially, said silencer comprising an adjusting nut having an introduction tube longitudinally of the nut and fitting in the expansion hole of the silencer to vary effective length of the silencer thereby preventing noise effectively.

2. A scroll fluid machine as claimed in claim 1 wherein the silencer is completely embedded in the discharge hole.

3. A scroll fluid machine as claimed in claim 1 wherein the silencer partially fits in the discharge hole.

4. A scroll fluid machine as claimed in claim 1 wherein the silencer detachably fits in the discharge hole.

* * * * *